US007478510B2

(12) United States Patent
Wilson et al.

(10) Patent No.: US 7,478,510 B2
(45) **Date of Patent: *Jan. 20, 2009**

(54) BREAK-AWAY CONCRETE FORM STAKE WITH SELF-SEALING FEATURE

(75) Inventors: Robert J. Wilson, West Palm Beach, FL (US); Gregory S. Foster, West Palm Beach, FL (US)

(73) Assignee: Vista Investments and Properties, LLC, West Palm Beach, FL (US)

( * ) Notice: Subject to any disclaimer, the term of this patent is extended or adjusted under 35 U.S.C. 154(b) by 935 days.

This patent is subject to a terminal disclaimer.

(21) Appl. No.: 10/733,909

(22) Filed: Dec. 11, 2003

(65) Prior Publication Data

US 2005/0126111 A1 Jun. 16, 2005

(51) Int. Cl.
*E04C 5/16* (2006.01)

(52) U.S. Cl. ..... 52/677; 52/155; 52/153; 52/98

(58) Field of Classification Search ..... 52/301, 52/708, 709, 153, 154, 103, 155, 98, 100, 52/165; 248/533; 135/118
See application file for complete search history.

(56) References Cited

U.S. PATENT DOCUMENTS

| | | | | |
|---|---|---|---|---|
| 3,011,597 | A * | 12/1961 | Galloway et al. | 52/154 |
| 4,251,971 | A | 2/1981 | Unthank | |
| 4,431,040 | A * | 2/1984 | Friedrich et al. | 144/195.5 |
| 4,443,981 | A | 4/1984 | Weiss | |
| 4,455,104 | A | 6/1984 | Weisbach | |
| 4,459,787 | A * | 7/1984 | Wilcox | 52/155 |
| 4,572,701 | A | 2/1986 | Parsons et al. | |
| 4,662,305 | A * | 5/1987 | Cline | 116/173 |
| 4,679,369 | A | 7/1987 | Kinsley et al. | |
| 4,765,277 | A * | 8/1988 | Bailey et al. | 119/57.9 |
| 4,832,304 | A * | 5/1989 | Morgulis | 248/533 |
| 4,926,785 | A * | 5/1990 | Lamson | 116/209 |
| 5,046,699 | A * | 9/1991 | Perreault et al. | 248/533 |
| 5,293,889 | A * | 3/1994 | Hall et al. | 135/16 |
| 5,564,232 | A * | 10/1996 | Callaway | 5/4 |
| 5,586,416 | A | 12/1996 | Hess, III et al. | |
| 5,830,378 | A | 11/1998 | Butler | |
| 5,884,439 | A | 3/1999 | Hess, III et al. | |
| 6,095,081 | A * | 8/2000 | Gochenour | 116/209 |
| 6,123,745 | A | 9/2000 | Hess, III et al. | |
| 6,349,514 | B1 | 2/2002 | Adams | |
| 6,367,764 | B1 | 4/2002 | Butler | |
| 6,547,203 | B1 | 4/2003 | Willard | |
| 6,899,187 | B1 * | 5/2005 | McCarthy | 175/19 |
| 7,174,681 | B2 * | 2/2007 | Wilson et al. | 52/169.14 |

FOREIGN PATENT DOCUMENTS

| | | |
|---|---|---|
| JP | 10191734 A2 | 7/1998 |

* cited by examiner

*Primary Examiner*—Basil Katcheves
(74) *Attorney, Agent, or Firm*—Darby & Darby PC; Robert J. Sacco

(57) ABSTRACT

Method for securing a foundation form disposed on a moisture barrier membrane. The method can include penetrating the moisture barrier membrane with one end of a stake, sealing a breach in the moisture barrier membrane around a periphery of the stake caused by the penetrating step; and removing a portion of the stake extending above the moisture barrier membrane. A sealing member can be disposed on the stake at a location along an axial length of the stake.

13 Claims, 5 Drawing Sheets

BREAK-AWAY CONCRETE FORM STAKE WITH SELF-SEALING FEATURE

BACKGROUND OF THE INVENTION

1. Statement of the Technical Field

The inventive arrangements relate generally to the field of building construction and more particularly to construction methods for concrete forms.

2. Description of the Related Art

Plastic membranes are commonly used in the construction industry to prevent moisture penetration through floors. The membranes are typically formed of polyethylene or other damp proof materials. Another advantage of such membranes is that they can help prevent intrusion into a construction by insects, such as subterranean termites. A poured, reinforced, crack-free concrete foundation hinders the passage of termites. However, most slabs have some minor cracks in them are created as a result of movements induced by stress, drying shrinkage or temperature variations. In this regard, studies have shown that termites can pass through a crack as small as 1.4 mm and will even widen existing cracks, depending on the relative strength of the concrete. Accordingly, a plastic membrane can help prevent the intrusion of termites in the event that any cracks should occur.

A typical construction will involve the placement of the membrane over a compacted soil surface where a concrete foundation or pad is to be poured. In preparation for pouring a foundation, concrete forms are placed at various locations around the perimeter of the pad and anywhere else they are needed. The forms are generally positioned on top of the moisture barrier membrane and held in place using long stakes that are driven through the membrane and into the soil. The concrete is then poured on top of the moisture barrier and within the confined area defined by the concrete forms. Finally, the stakes are removed as the concrete begins to set.

The foregoing approach has been used for many years with good results, but it is not without its drawbacks. For example, the moisture barrier's effectiveness can be seriously compromised by the existence of any punctures or tears that allow moisture or insects direct access to the concrete. Even if great care is used to lay the membrane, punctures inevitably result when the stakes are driven into the soil to hold the concrete forms in place. This is a serious problem as it allows for the intrusion of moisture and insects behind the moisture barrier. Despite the obvious flaws in this approach, it continues to be used extensively in the construction trade because there has been no satisfactory alternative approach available.

SUMMARY OF THE INVENTION

The invention concerns a method for securing a foundation form disposed on a moisture barrier membrane. The method can include the steps of placing a sealing member on a stake at a location disposed along an axial length thereof to form a seal around a perimeter of the stake, penetrating the moisture barrier membrane with one end of the stake, and forming a seal between the sealing member and the moisture barrier membrane around a point where the stake penetrates the moisture barrier membrane. The seal can be formed by sliding the sealing member along the axial length of the stake to a location disposed adjacent to the moisture barrier membrane. The sealing member can include a flexible base portion located on a portion thereof that forms the seal around a perimeter of the stake. The base can be formed of any material that forms an effective moisture barrier and which is compatible with the moisture barrier membrane. The method can also include the step of breaking off a portion of the stake that would otherwise remain exposed after concrete has been poured over the moisture barrier.

The method can also include the step of selecting the sealing member to include an elastic portion located on a portion thereof that forms the seal around a perimeter of the stake. Further, the seal between the sealing member and the moisture barrier membrane can be enhanced by using an adhesive sealant disposed between the two surfaces. For example, the sealing member can include an adhesive sealant disposed on a surface thereof that can be exposed by removal of a non-stick tape.

The method can also include the step of selecting the stake to include at least one bore extending through the stake in a direction generally transverse to the axial length thereof. In that case, the method can also include the step of securing the stake to the foundation form. For example, this can be accomplished by driving at least one of a nail and a screw through the bore formed in the stake and into the foundation form.

The method can also include selecting the sealing member to include a ridge disposed on an outer rim thereof. In this way, a channel can be formed between the perimeter of the stake and the outer rim of the sealing member when the sealing member is placed on the stake. A pesticide can be disposed in the channel for inhibiting the intrusion of insects around the stake.

According to another aspect, the invention can include a method for securing a foundation form disposed on a moisture barrier membrane. The method can include penetrating the moisture barrier membrane with one end of a stake, sealing a breach in the moisture barrier membrane around a periphery of the stake caused by the penetrating step; and removing a portion of the stake extending above the moisture barrier membrane. A sealing member can be disposed on the stake at a location along an axial length of the stake. The sealing member can extend radially away from an axis defined along a length of the stake. An opening in the moisture barrier membrane caused by piercing it with the stake can be sealed by sliding the sealing member along an axial length of the stake to a location disposed adjacent to the moisture barrier membrane. In this regard the sealing member can include a flexible portion that seals around a perimeter of the stake. The sealing member can be selected to include an elastic or resilient portion that seals around a perimeter of the stake. A seal between the sealing member and the moisture barrier membrane can be enhanced by using an adhesive sealant. According to one aspect of the invention, the sealing member can include an adhesive pre-disposed on a surface thereof. The adhesive can be exposed by removing a strip of non-stick tape that protects and covers the adhesive until the sealing member is ready for use.

The form of the stake can be selected so as to include at least one bore extending through the stake in a direction transverse to an axis defined along a length of the stake. Further the method can include the step of securing the stake to the foundation form. The securing step can be comprised of driving at least one of a nail and a screw through the bore, and into the foundation form. The method can also include the step of breaking off a portion of the stake that remains exposed after concrete has been poured over the moisture barrier.

The sealing member can be selected to include a ridge disposed on an outer peripheral rim thereof. In this way, a channel can be formed between the stake and an outer rim of the sealing member. Further, the method can include the step of disposing a pesticide in the channel.

The invention can also include an apparatus for securing a foundation form disposed on a moisture barrier membrane. The apparatus can include an elongated stake and a sealing member disposed at a location along an axial length of the stake forming a seal around a periphery of the stake at the location and extending radially away from an axis defined along a length of the stake. The apparatus can also include a sealant disposed on a surface of the sealing member facing the membrane (i.e., on a side of the stake nearest the pointed tip).

According to one aspect of the invention the sealing member can be slidably mounted to the stake along an axial length thereof. The sealing member can include a flexible portion that forms the seal around the periphery of the stake. The flexible portion can be formed of an elastic or resilient material to improve the seal the seal around the periphery of the stake. The sealing member can also include a ridge disposed on an outer rim thereof spaced apart from the periphery of the stake. The ridge can partially define a channel formed between the periphery of the stake and an outer rim of the sealing member spaced apart from the periphery.

The stake can include at least one bore extending through the stake in a direction transverse to the axis. The stake can also comprise at least one structure to permit a portion of the stake to be removed. The structure can define a break point where the stake is designed to be break when struck forcefully in a direction transverse to the axis.

According to another aspect, the invention can include a disposable stake for a foundation. The elongated stake can include at least one structure to permit a portion of a length of the stake to be removed. For example, the structure can define a break point where the stake is designed to be break when struck forcefully in a direction transverse to an axis defined along the length of the stake.

DETAILED DESCRIPTION OF THE PREFERRED EMBODIMENTS

Figure 1A:
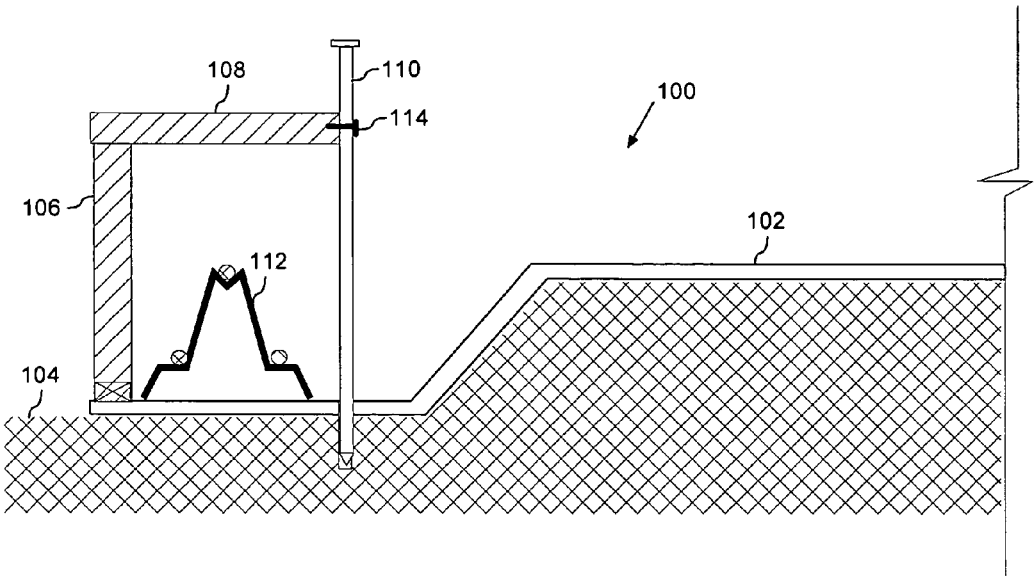
Fig. 1A (Prior Art)
FIGS. 1A and 1B are a series of drawings useful for understanding the prior art.
Figure 1B:
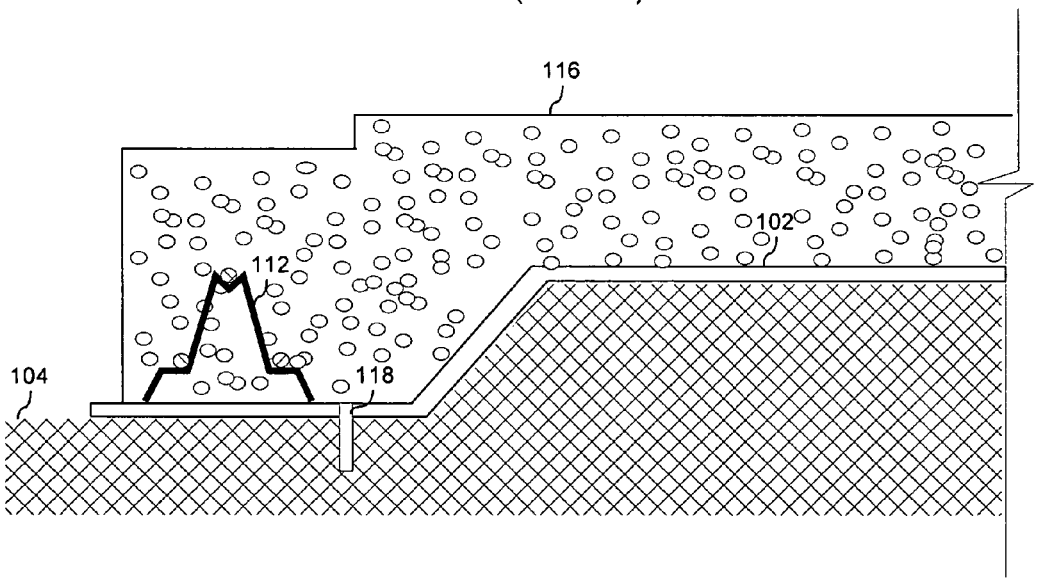
Fig. 1B (Prior Art)

FIG. 1A is a cross-sectional view of a portion of a typical building site 100 that has been prepared for the pouring of a concrete foundation. The building site includes a moisture barrier membrane 102 disposed over compacted soil 104, and a slab form 106 that will serve to contain a poured concrete slab until such times as it cures. Additional slab forms are conventionally disposed around a perimeter of the building site to constrain the wet concrete and define any necessary details in the foundation. For example, a form 108 can be used to create a depression in the slab for receiving a wood or metal structural member. Structural reinforcements 112 are typically provided along portions of the slab where heavy loading is anticipated. Rigid metal stakes, such as stake 110 are commonly used to hold the position of the various forms 106, 108 while the concrete is allowed to cure. As shown in FIG. 1A, a fastening device 114 is used to secure the form 108 to the stake 110. The fastening device 114 conventionally used in such prior art arrangements is usually a screw or a nail that passes through a bore provided in the stake 110. The fastening device secures the stake 110 to the form 108 while the slab is poured and the concrete begins to cure. Before the concrete is fully cured, the stake can be removed as shown in FIG. 1B and the surface of the concrete can be smoothed over to close any opening in the still uncured concrete that may be left behind by the now removed stake 110. Still, the removal of the stake 110 will leave an opening 118 in the moisture barrier membrane 102 that can allow moisture and insects direct access to the slab. This is highly undesirable.

Figure 2:
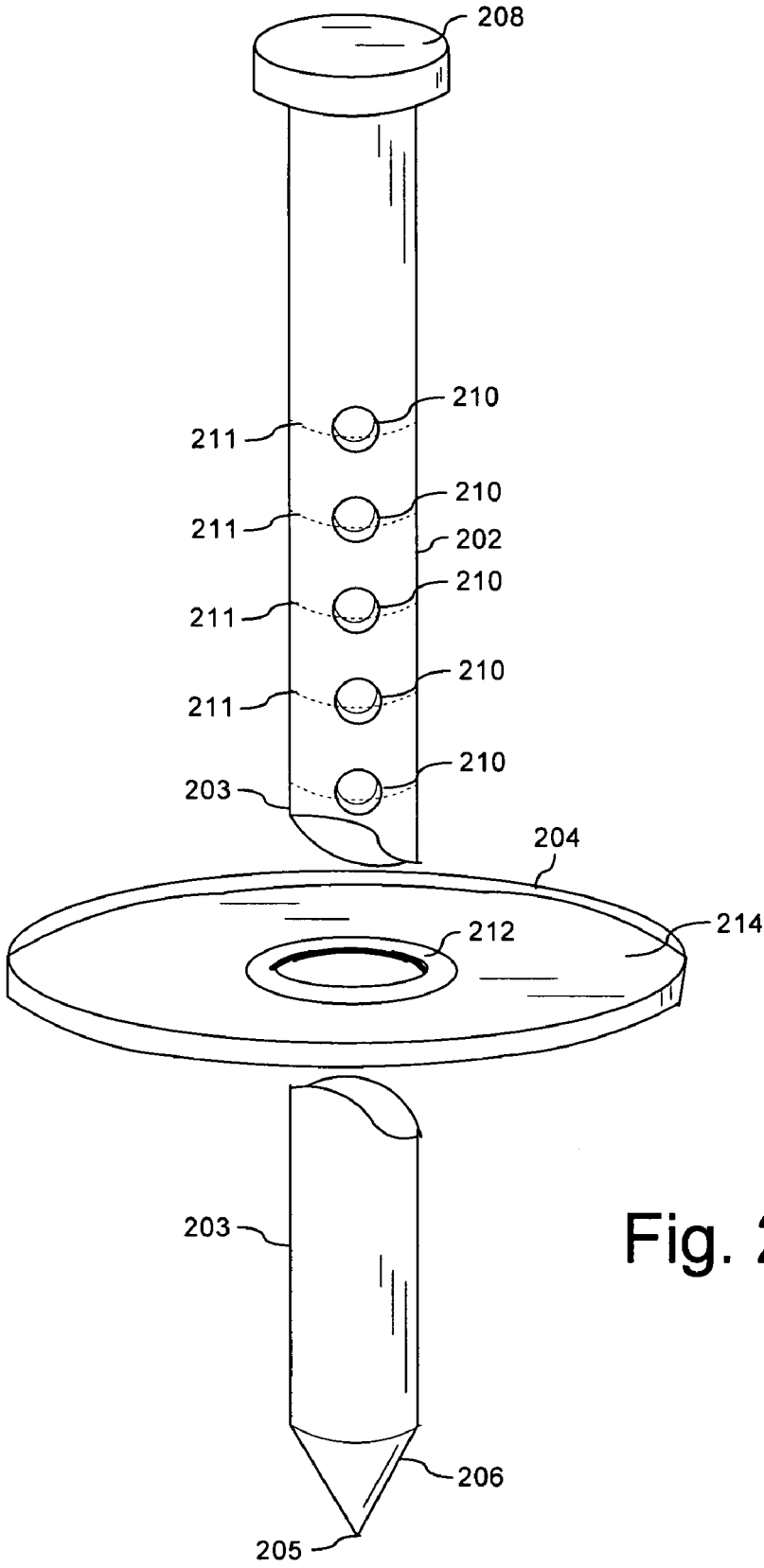
FIG. 2 is a perspective view of a break-away concrete form stake that is useful for understanding the inventive arrangements

In order to overcome the deficiencies of the prior art, a break-away type stake can be used. An example of such a stake is illustrated in FIG. 2. Stake 202 can include an elongated body 203 that extends from a head 208 to an opposing end 205. A portion of the stake body 203 is omitted from the drawing in FIG. 2 for greater clarity. However, it should be understood that the stake is continuous between the head 208 and the opposing end 205. Stake 202 can be formed of a rigid material that is suitable for penetrating a moisture barrier membrane and being driven into compacted soil.

The stake can have a circular cross-sectional profile as shown in FIG. 2, but any of a wide variety of other cross-sectional profiles are also acceptable. For example, square, rectangular and octagonal cross-sectional profiles are acceptable. Those skilled in the art will appreciate that the invention is not limited to any particular cross-sectional profile. The stake can have a tapered end 206 to help facilitate penetration of a moisture barrier membrane and passage through the soil. However, a tapered end is not required in this regard. For example, a blunt ended stake can is acceptable and can also be driven into the soil provided that enough driving force is used. The head 208 can be slightly larger than the diameter of the remainder of the stake. However, an enlarged head 208 is also optional and head 208 can instead be of generally the same cross-sectional size as the body 203.

A series of bores 210 can be formed at locations distributed along at least an upper portion of the stake. The bores can be sized for receiving a fastening device such as a nail, peg or screw. In this way, the fastening device can be used to secure the concrete form to the stake while a concrete slab is poured and begins to cure. According to one embodiment, the stake can be weakened at selected break points 211 along its length. For example, these break points can coincide with bores 210 as shown in FIG. 2. The bore can weaken the stake to increase its tendency to shear when subjected to forces transverse to the elongated length of the stake. Alternatively, or in addition thereto, the stake can be hollowed, scored on its outer surface, or can have a modified cross-sectional profile that can be used to create the break point. Those skilled in the art will appreciate that there are a wide variety of other structural modifications that can be made to a rigid body such as stake 202 that will be effective for reducing its shear strength. Any of these modifications and techniques are acceptable for the purpose of the invention.

Figure 3A:
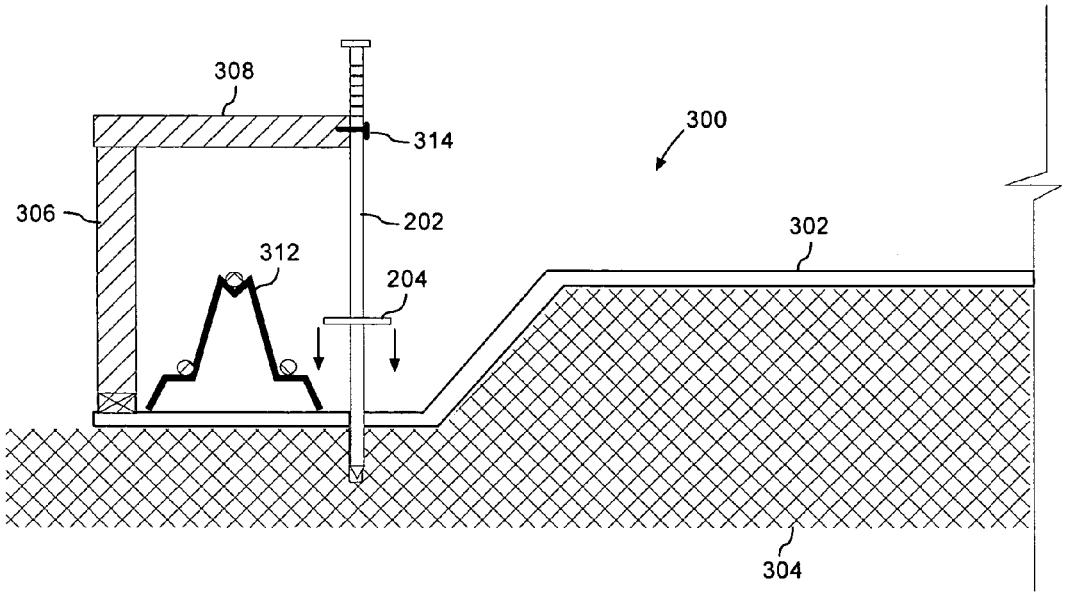
FIG. 3A is a cross-sectional view of a portion of a building site that has been prepared for the pouring a concrete foundation and in which a sealing member is ready to form a seal with a moisture barrier.
Figure 3B:
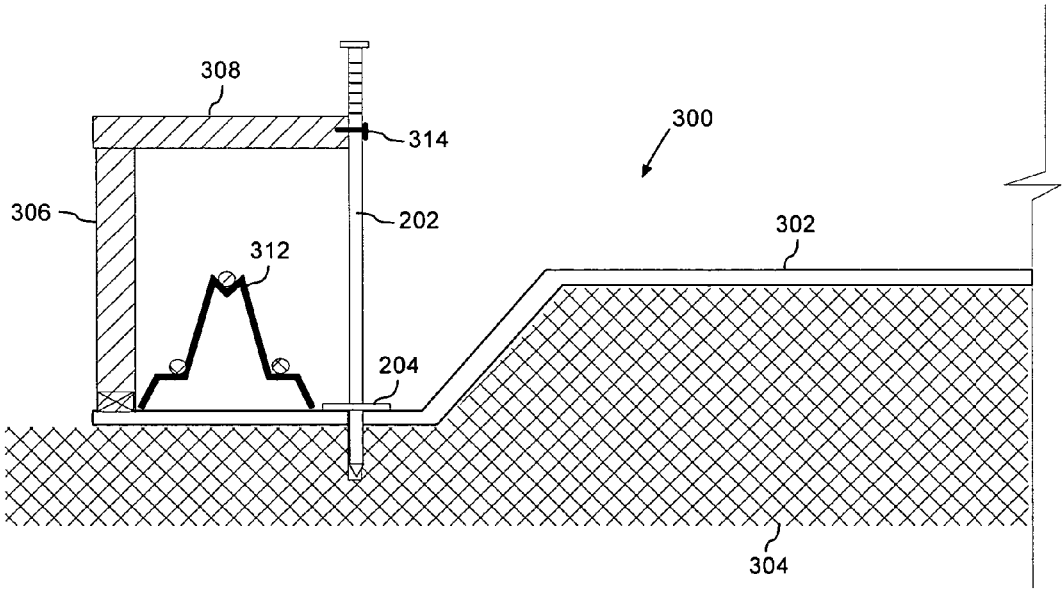
FIG. 3B shows the cross-sectional view of FIG. 2A in which the sealing member has been moved along the stake to a location adjacent the moisture barrier membrane.
Figure 3C:
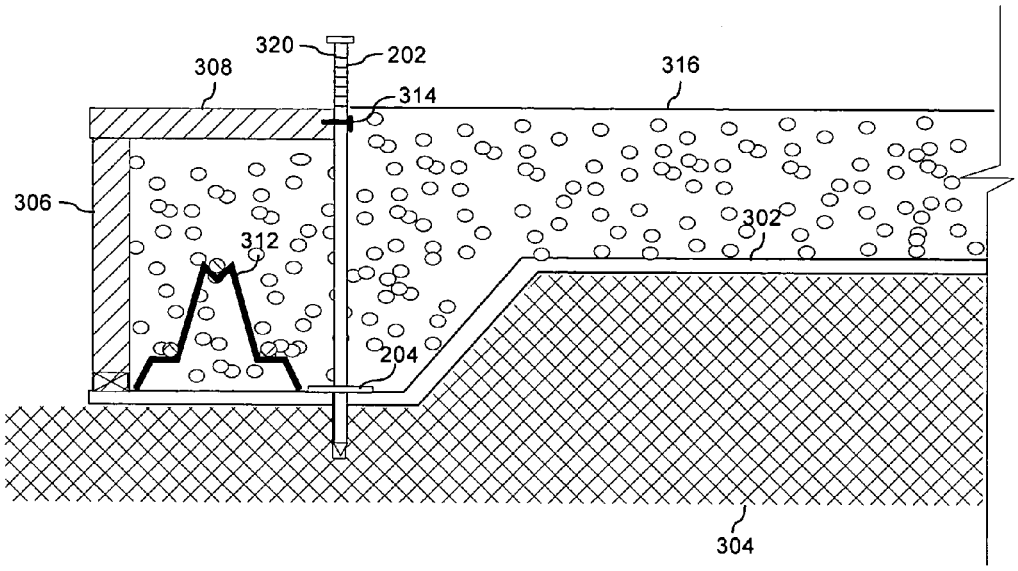
FIG. 3C shows the cross-sectional view of FIG. 2B in which concrete has been poured over the moisture barrier membrane.

The invention shall now be further described with reference to FIGS. 3A-3D. FIG. 3A shows a cross-sectional view of a portion of a building site 300 that has been prepared for the pouring of a concrete foundation. The building site includes a moisture barrier membrane 302 disposed over compacted soil 304, and a slab form 306 that will serve to contain a poured concrete slab until such times as it cures. As is well known in the art, additional forms can also be used for creating a building slab. For example, a form 308 can be used to create a depression in the slab for receiving a wood or metal structural member (not shown). Those skilled in the art will appreciate that the invention is not limited to those particular forms that are shown in FIGS. 3A-3C. Conventional structural reinforcements 312 can also be provided along portions of the slab where heavy loading is anticipated.

Slab forms such as forms 308 and 306 can be secured in place using stake 202. Only one stake 202 is shown in FIG. 3A-3D. However, those skilled in the art will appreciate that a plurality of such stakes may be used to secure any number of forms 308 and 306 in multiple locations. Each stake 202 can pierce the moisture barrier membrane 302 and can be driven into the compacted soil beneath the building site. In this way, the stake 202 can be used to hold the position of the various forms 306, 308 until such time as uncured concrete can be poured to create the slab. Advantageously, the stake 202 can be driven into the soil to a depth that is sufficient for securing the form and generally positions one of the break points 211 at a selected height above the soil surface. In this way, the break point can be generally aligned with an anticipated upper surface of the concrete slab. Fastening device 314 can be used to secure the various concrete forms to the stake while the slab is poured and begins to cure. Fastening device 314 can be a nail, peg or screw, but the invention is not limited in this regard. Fastening device 314 can be any suitable structure capable of securing the form to the stake.

Figure 3D:
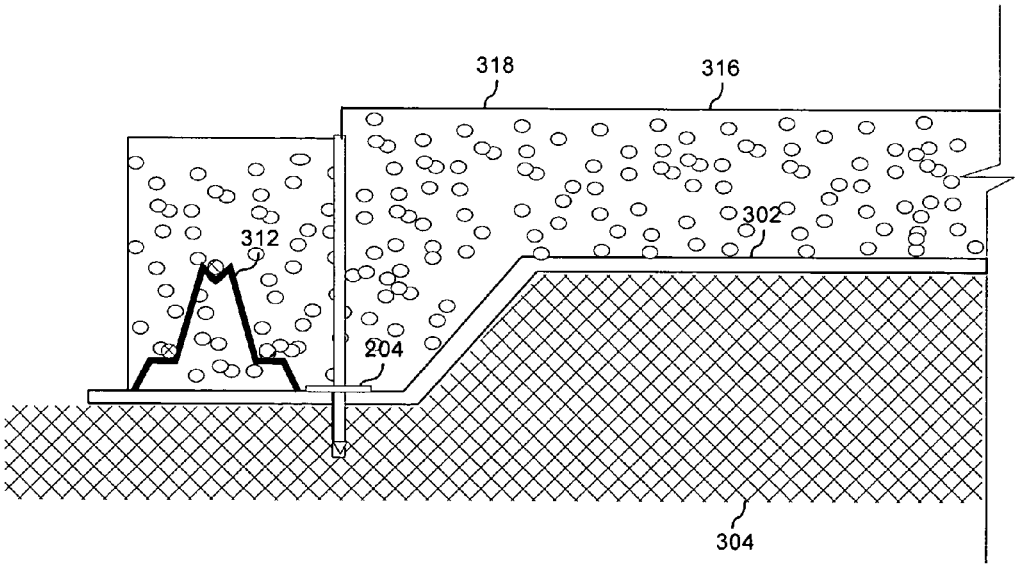
FIG. 3D shows the cross-sectional view of FIG. 2B in which the forms have been removed from the poured foundation and a portion of the stake has been broken away.

Referring now to FIGS. 3C and 3D, concrete 316 can be poured to form the slab 316 using conventional techniques. However, rather than removing each stake 202 from the slab and smoothing over the upper surface 316 of the concrete in accordance with conventional methods, the, stake 202 can be allowed to remain as the concrete cures. In this way, it is possible to avoid creating a substantial opening in the moisture barrier membrane that would be otherwise caused by the removal of the stake. After the concrete 316 has cured, or at least begun to cure, a portion 320 of stake 302 projecting above the upper surface 318 of the concrete slab 316, can be removed. This can be accomplished by striking the stake 202 transversely with a tool, such as a hammer, to break away an upper portion 320. When struck in this way, the stake will tend to break transversely at one of the break points 211 that is generally aligned with the upper surface 316 of the slab. Alternatively, if break points 211 are not provided along the length of the stake, a cutting tool can be used to remove the excess portion of the stake extending above the upper surface 318 of the slab. The completed slab with the upper portion of the stake removed is shown in FIG. 3D.

According to one embodiment, the end 205 of stake 202 can be sufficiently tapered, sharpened or otherwise formed so as to cleanly pierce the surface of the moisture barrier membrane 302 with a minimum of pulling, tearing or deformation of the membrane in the area surrounding the stake. Consequently, the moisture barrier membrane 302 can fit snugly around the outside of the stake 202 so as to substantially form a seal therewith. A waterproof sealing agent such as silicone rubber can optionally be applied around the periphery of the stake where it pierces the moisture barrier membrane. In this way, exposure of the slab to water and insect intrusion can be further minimized.

The invention is not limited to any particular shape or taper formed on end 205 of the stake provided that it cleanly pierces the surface of the moisture barrier membrane 302 with a minimum of pulling, tearing or deformation of the membrane in the area surrounding the stake. Such deformation and tearing can adversely affect any seal formed around the stake. Further, the end 205 should have a profile that ensures that the shape of any opening formed in the moisture barrier membrane closely fits around the outer surface of the stake 202 where it passes through the membrane. At the present time, stakes having a sharp tapered end and a circular cross-sectional profile are believed to serve this purpose best. However, the invention is not limited in this regard and any combination of end shape and cross-sectional profile can be used provided that the requisite seal around the stake is formed.

Those skilled in the art will appreciate that the seal formed around the stake 202 when it pierces the moisture barrier membrane 302 may not be adequate in all instances to preclude moisture and insect intrusion. In such instances, it can be desirable to provide additional safeguards to form a more effective seal. Accordingly, in a second embodiment, the stake 202 can optionally be provided with a sealing member 204 as illustrated in FIG. 2.

The sealing member 204 can include a sleeve 212 and a base 214. The sleeve 212 can be comprised of any suitable structure to create a moisture seal around the outer perimeter of the stake 202. Likewise, the base can be formed of any material that forms an effective moisture barrier and which is compatible with the moisture barrier membrane. According to one aspect of the invention, the sleeve 212 can be designed to slide along the length of the stake 202.

The sleeve 212 can advantageously be formed of an elastic or resilient material such as silicone rubber, a polymer plastic, or any other suitable material. Further, the opening defined by the sleeve 212 can be formed slightly smaller in size as compared to the outer diameter of the stake 202. Consequently, when the stake is forced through the opening defined by the sleeve, a substantially watertight seal can be achieved. Alternatively, the sleeve can be formed of a material that is neither resilient or elastic. In that case, the sleeve can have a size and profile selected to simply form a close fit with the outer surface of the stake 202 so as to limit moisture intrusion. Other methods of forming a moisture resistant seal between the sleeve and the stake are also possible and the invention is not intended to be limited to the embodiments described herein.

Referring now to FIG. 3A, the sealing member can be slid along the length of stake 202 after the stake has been positioned so as to engage the surface of the moisture barrier membrane 302. A waterproof sealant or adhesive can be applied between the base 214 of sealing member 204 and the opposing surface of the moisture barrier membrane 302 in order to prevent moisture from passing between the two surfaces. For example a silicone sealer or any other type of waterproof sealing agent can be used that is compatible with the materials of the moisture barrier membrane and the sealing member. According to one embodiment, a sealant or adhesive can be pre-disposed on the surface of the base 214. In that case, the adhesive can be protected by a non-stick tape that can be removed when the sealing member is ready for use. For additional protection against water intrusion, a waterproof sealing agent such as silicone rubber can be applied around the periphery of sleeve 212 where it meets the outer surface of the stake 202.

Figure 4:
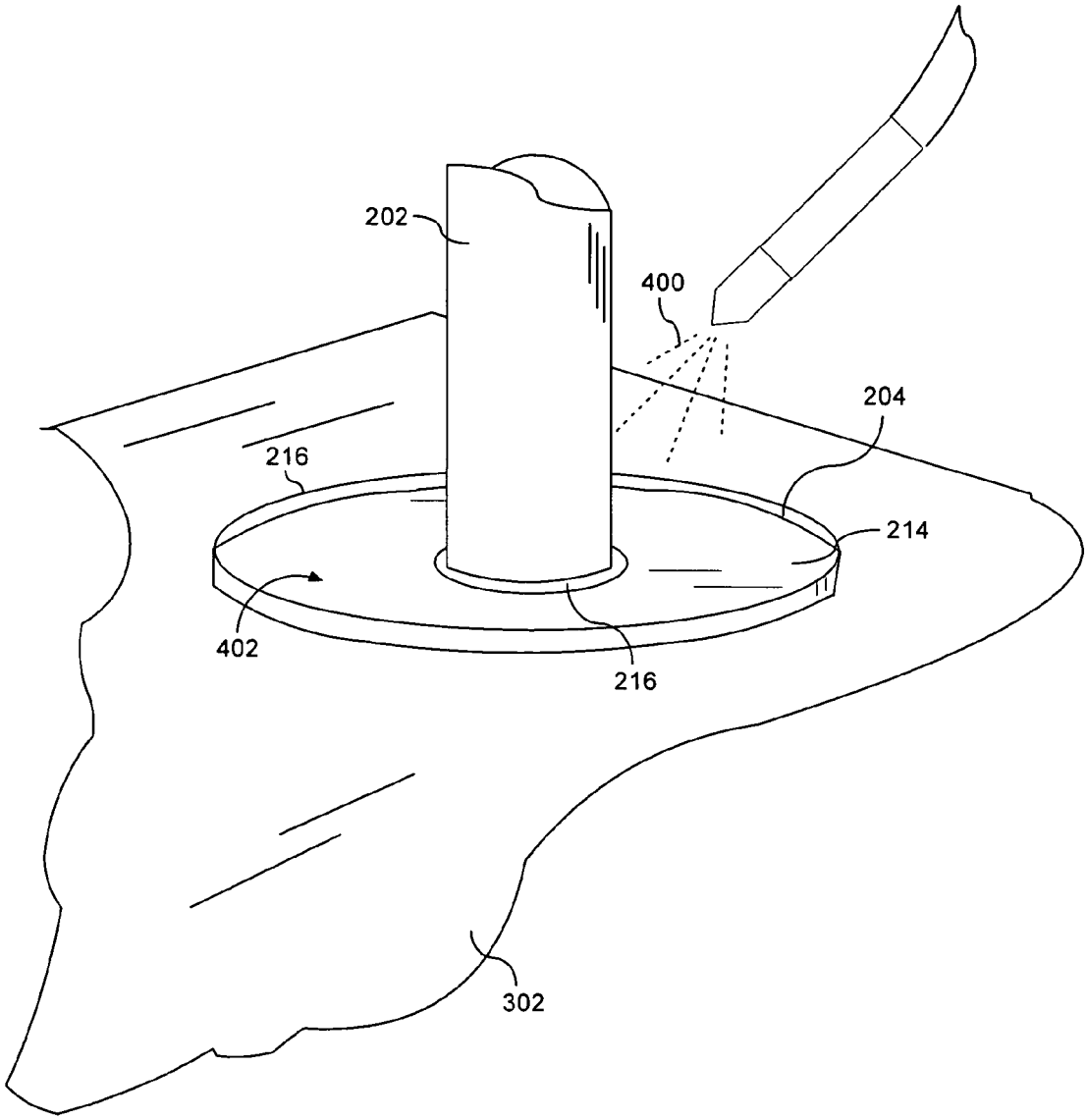
FIG. 4 is an enlarged perspective view showing the sealing member forming a seal where the stake has pierced the moisture barrier membrane.

Referring now to FIG. 4, it may be observed that the sealing member 204 can also include a ridge 216 disposed on an outer rim thereof spaced apart from the periphery of the stake 202. The ridge 216 can partially define a channel 402 formed between the periphery of the stake and an outer rim of the sealing member. The channel can be useful for helping to confine a pesticide 400 that can be applied to the area around the perimeter of the stake 202.

According to one aspect of the invention, the sleeve 212 of the sealing member 204 can be bonded to the outer surface of the stake 202 so as to form a seal therewith. In that case, the sealing member cannot be slid along the length of stake and the stake must instead be driven into the soil a sufficient distance to ensure that he sealing member engages the surface of the moisture barrier membrane. After a seal has been formed between the sealing member 204 and the moisture barrier membrane, the concrete slab can be poured and the upper portion of the stake can be removed as described above.

The invention claimed is:

1. Apparatus for securing a foundation form disposed on a moisture barrier membrane comprising:

a stake comprised of an elongated body extending along a defined axis and formed of a rigid material, said stake extends from a head forming a first end of an upper portion of said elongated body to a tapered tip forming an opposing second end of a lower portion of said elongated body;

a sealing member disposed at a location along a length of said stake forming a seal around a periphery of said stake at said location and extending radially away from said axis; and wherein said upper portion comprises a frangible section separable from a remainder of said elongated body at a location defined by at least one break-point where said elongated body includes a modified section which is configured to provide a reduced shear strength as compared to a remainder of said elongated body, said modified section comprised of a bore formed in said elongated body transverse to said axis, and a scored portion on the outer surface of said elongated body aligned with said bore which further reduces a cross-sectional area of said elongated body at said break point.

2. The apparatus according to claim 1 further comprising a sealant disposed on a surface of said sealing member nearest said tapered tip.

3. The apparatus according to claim 1 wherein said sealing member is slidably mounted to said stake along a length thereof.

4. The apparatus according to claim 1 wherein said sealing member includes a flexible portion that forms said seal around said periphery of said stake.

5. The apparatus according to claim 1 wherein said sealing member includes at least one of an elastic or resilient portion that forms said seal around said periphery of said stake.

6. The apparatus according to claim 1 wherein said sealing member includes a ridge disposed on an outer rim thereof spaced apart from said periphery of said stake.

7. The apparatus according to claim 1 further comprising a channel formed between said periphery of said stake and an outer rim of said sealing member spaced apart from said periphery.

8. A disposable stake for a foundation form comprising:

a stake comprised of an elongated body extending along a defined axis and formed of a rigid material, said stake extends from a head forming a first end of an upper portion of said elongated body to a tapered tip forming an opposing second end of a lower portion of said elongated body;

a sealing member disposed at a location along a length of said stake forming a seal around a periphery of said stake at said location and extending radially away from said axis, a sealant disposed on a surface of said sealing member nearest said tapered tip, and a non-stick tape disposed on said sealant;

wherein said upper portion comprises a frangible section separable from a remainder of said elongated body at a location defined by at least one break-point where said elongated body is modified to provide a reduced shear strength as compared to a remainder of said elongated body, said break point comprising a structural modification of said elongated body selected from the group consisting of a scored portion, a hollowed portion, and a bore formed transverse to a length of said stake.

9. The apparatus according to claim 8 wherein said sealing member is slidably mounted to said stake along said length thereof.

10. The apparatus according to claim 8 wherein said sealing member includes a flexible portion that forms said seal around said periphery of said stake.

11. The apparatus according to claim 8 wherein said sealing member includes at least one of an elastic or resilient portion that forms said seal around said periphery of said stake.

12. The apparatus according to claim 8 wherein said sealing member includes a ridge disposed on an outer rim thereof spaced apart from said periphery of said stake.

13. The apparatus according to claim 8 further comprising a channel formed between said periphery of said stake and an outer rim of said sealing member spaced apart from said periphery.

* * * * *